US007881882B2

(12) United States Patent
Maxey et al.

(10) Patent No.: US 7,881,882 B2
(45) Date of Patent: Feb. 1, 2011

(54) APPARATUS AND METHOD FOR DETECTING TAMPERING IN FLEXIBLE STRUCTURES

(75) Inventors: Lonnie C. Maxey, Knoxville, TN (US); Howard D. Haynes, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 11/526,970

(22) Filed: Sep. 25, 2006

(65) Prior Publication Data

US 2008/0077333 A1 Mar. 27, 2008

(51) Int. Cl.
*G08B 13/00* (2006.01)

(52) U.S. Cl. ..... 702/42; 702/57; 340/562; 340/566

(58) Field of Classification Search ..... 702/33–36, 702/38, 41–43, 57, 58; 340/561–567
See application file for complete search history.

(56) References Cited

U.S. PATENT DOCUMENTS 3,763,482 A * 10/1973 Burney et al. ..... 340/564
3,846,780 A * 11/1974 Gilcher ..... 340/562
4,197,529 A * 4/1980 Ramstedt et al. ..... 340/566
4,365,239 A * 12/1982 Mongeon ..... 340/564
4,598,168 A * 7/1986 Wagner et al. ..... 174/115
4,602,246 A * 7/1986 Jensen ..... 340/521
4,875,198 A * 10/1989 Ariav ..... 367/93
5,268,672 A * 12/1993 Kerr ..... 340/565
5,959,534 A * 9/1999 Campbell et al. ..... 340/573.6
6,288,640 B1 * 9/2001 Gagnon ..... 340/539.17
6,351,214 B2 * 2/2002 Eskildsen et al. ..... 340/550
6,577,236 B2 * 6/2003 Harman ..... 340/552
6,967,584 B2 11/2005 Maki
7,116,943 B2 * 10/2006 Sugar et al. ..... 455/67.11
7,123,785 B2 * 10/2006 Iffergan ..... 385/13
2004/0230387 A1 * 11/2004 Bechhoefer ..... 702/58
2006/0164233 A1 * 7/2006 Meng et al. ..... 340/522
2006/0256344 A1 * 11/2006 Sikora et al. ..... 356/477

FOREIGN PATENT DOCUMENTS

EP 448290 A2 * 9/1991

OTHER PUBLICATIONS

URL: http://www.perimeterproducts.com; Magal-Senstar, Inc. Fence Protection Systems, printed—Sep. 18, 2006.
GE Interlogix product literature, E-Flex 3i Interior Security System, Jun. 10, 2003.

* cited by examiner

*Primary Examiner*—Jeffrey R West
(74) *Attorney, Agent, or Firm*—Brinks Hofer Gilson & Lione

(57) ABSTRACT

A system for monitoring or detecting tampering in a flexible structure includes taking electrical measurements on a sensing cable coupled to the structure, performing spectral analysis on the measured data, and comparing the spectral characteristics of the event to those of known benign and/or known suspicious events. A threshold or trigger value may used to identify an event of interest and initiate data collection. Alternatively, the system may be triggered at preset intervals, triggered manually, or triggered by a signal from another sensing device such as a motion detector. The system may be used to monitor electrical cables and conduits, hoses and flexible ducts, fences and other perimeter control devices, structural cables, flexible fabrics, and other flexible structures.

5 Claims, 5 Drawing Sheets

APPARATUS AND METHOD FOR DETECTING TAMPERING IN FLEXIBLE STRUCTURES

STATEMENT REGARDING FEDERALLY SPONSORED RESEARCH

This invention was made with Government support under Contract No. DE-AC05-00OR22725 awarded by the U.S. Department of Energy to UT-Battelle, LLC, and the Government has certain rights in this invention.

BACKGROUND OF THE INVENTION

1. Field of the Invention

The invention pertains to apparatus and methods for monitoring cables or electrical conduits to detect tampering. More particularly, the invention pertains to tamper detection using a distributed capacitance or resistance sensing circuit followed by spectral analysis of the sensor data.

2. Description of Related Art

In the field of communications and physical security, there is often a need to detect intrusions, for example, through a perimeter fence or the like, as well as detect tampering with a cable that might be carrying sensitive data. Such systems traditionally function by defining "normal" versus "alarm" states in terms of some threshold value of one or more parameters. In the simplest case, a trip wire or window alarm simply detects the breakage of electrical continuity of a circuit loop. Motion detectors based on ultrasonics, active infrared, or passive infrared detect changes in an incoming or reflected audio or optical signal and trigger an alarm when the magnitude of the signal exceeds some threshold. Such devices usually have some form of "sensitivity" control, which adjusts the threshold level in an effort to minimize false alarms.

It is well known that electrical cables and conduits may display minute electrical changes in response to physical contact, movement, or vibration. Cables can be constructed to enhance such "microphonic" effects by, for instance, adding materials with large triboresistive coefficients such as taught by Maki in U.S. Pat. No. 6,967,584, the entire disclosure of which is incorporated herein by reference.

One system that exploits this approach is the E-Flex 3i Interior Security System, [GE Interlogix UK, Unit 5, Ashton Gate, Ashton Road, Harold Hill, Romford, Essex RM3 8UF, England]. It was developed for use as an intruder detection system for building interiors. It uses a "strain sensitive" cable to detect vibrations of surfaces where the cable is installed, including walls, ceilings, floors and pipes. The cable is attached to a signal processor unit that monitors the cable electrical signal and compares the signal magnitude to a threshold level. If the signal magnitude exceeds the threshold level, an "event" is detected and indicated. Several controls are provided by that system. These include: (a) Signal frequency band control—used to filter either low-frequency or high-frequency noise from the signal prior to comparison against the threshold level. (b) Sensitivity control—used to vary the threshold level. (c) Event counter control—used to count the events detected by the system. (d) Time window control—used in conjunction with the event counter control to set the time interval during which events are counted. The primary method used by the system to detect intruders appears to rely on counting the number of times the magnitude of a pre-filtered signal exceeds a preset threshold within a preset time period.

Another commercial product that uses a capacitive sensor cable to detect intruders is the Fence Protection Systems from Perimeter Products, Inc. [now called Magal-Senstar, Inc. 43180 Osgood Rd., Fremont, Calif. 94539]. Magal-Senstar literature states that climbing produces low-frequency noise, while cutting produces high-frequency noise. The total signal bandwidth analyzed by that system is from 80 Hz to 3 kHz.

In many situations a conduit to be monitored will be subject to various extraneous physical vibrations, accidental impacts, etc. In order to minimize the occurrence of false alarms, it is necessary for the monitor to be able to reliably distinguish between benign and suspicious signals and to do so with minimal operator intervention. In most instances systems are designed with very general parameter sets that enable them to reject the most commonly encountered types of noise signals while reliably detecting intrusion or tampering events. Inevitably, the generality of this process creates a lack of precision in distinguishing between noise and intrusion signals. As a result, parameters must be set low enough to avoid an excessive number of false alarms yet high enough to provide a good probability of detecting invasive activities. Because noise sources can be highly specific to a given location or installation, it would be useful for the systems to be able to specifically recognize (through a learning process) the known noise sources that may be associated with a given installation. This would enable more rigorous detection of invasive activities and more robust rejection of known noise signals.

OBJECTS AND ADVANTAGES

Objects of the present invention include the following: providing an apparatus to detect tampering in a structural cable, an electrical cable, or a conduit; providing an apparatus to discriminate tampering events from background vibrations in a cable; providing an apparatus that acquires capacitance signals from an electrical cable and compares the spectral content of the signals with the spectral characteristics of known tampering events and/or known benign events; providing a method for detecting tampering in a structural cable, an electrical cable, or a conduit; providing a method for obtaining capacitance signals from an electrical cable and determining their spectral characteristics; and, providing a method for detecting tampering in a cable through spectral analysis of capacitance signals. These and other objects and advantages of the invention will become apparent from consideration of the following specification, read in conjunction with the drawings.

SUMMARY OF THE INVENTION

According to one aspect of the invention, an apparatus for detecting tampering in a flexible structure comprises: a sensor cable configured to mechanically contact a structure and configured to produce an electrical signal in response to mechanical forces; a data acquisition system configured to measure the electrical signal at selected times; and, a data analysis system further comprising a tangible medium containing instructions that when executed by one or more processors performs a method comprising:

collecting sample data for a selected sampling time interval;

performing spectral analysis on the sample data over at least two spectral intervals and determining at least one characteristic parameter of each of said intervals;

comparing the characteristic data parameters of the sample data to those associated with known events; and, indicating an alarm condition when the characteristic parameters of the sample data satisfy at least one condition selected from the following group: (a) the parameters deviate from those of a known benign events, and (b) the parameters match those of a known suspicious event.

According to another aspect of the invention, a method for detecting tampering in a flexible structure comprises the following steps:

a. disposing a sensor cable in mechanical contact with a structure, the cable configured to produce an electrical signal in response to mechanical forces;

b. measuring the electrical signal at selected times;

c. analyzing the electrical signal, the analysis including the following functions:

collecting sample data for a selected sampling time interval;

performing spectral analysis on the sample data over at least two spectral intervals and determining at least one characteristic parameter of each of the intervals;

comparing the characteristic data parameters of the sample data to those associated with known events; and, indicating an alarm condition when the characteristic parameters of the sample data satisfy at least one condition selected from the following group: (a) the parameters deviate from those of a known benign events, and (b) the parameters match those of a known suspicious event.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore non-limiting embodiments illustrated in the drawing figures, wherein like numerals (if they occur in more than one view) designate the same elements. The features in the drawings are not necessarily drawn to scale.

DETAILED DESCRIPTION OF THE INVENTION

In one preferred form, the invention comprises the following basic components. First, an amplifier responds to electrical changes in a cable (for example, capacitance changes as measured between two of the conductors in the cable) and converts these changes to an amplified analog electrical signal. Second, a data acquisition system converts the analog electrical signal into a digital data set for further analysis. Third, a data analysis system performs spectral analysis on the electrical signal. Fourth, a computer compares the spectral characteristics of the signal to the characteristics of known benign and/or known suspicious events. The computer preferably employs a multi-tiered approach in which several spectral characteristics are tested and an alarm condition is only indicated when each of the examined characteristics meets the "suspicious" criterion. While a computer-based system enables these functions to be performed in a convenient and flexible manner, it will be appreciated that any given set of spectral analysis characterizations could also be carried out using dedicated analog electronic circuits, digital signal processing (DSP) chips or other means to obtain the same ultimate data.

Figure 1A:
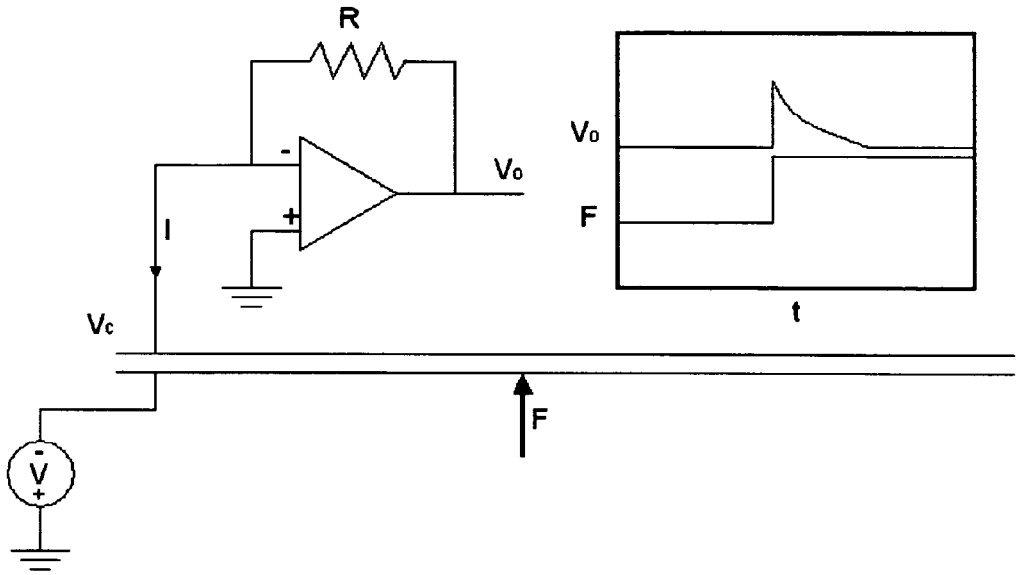
FIG. 1A is a schematic diagram of one embodiment of the present invention and a schematic plot of the output voltage in response to an applied force.
Figure 1B:
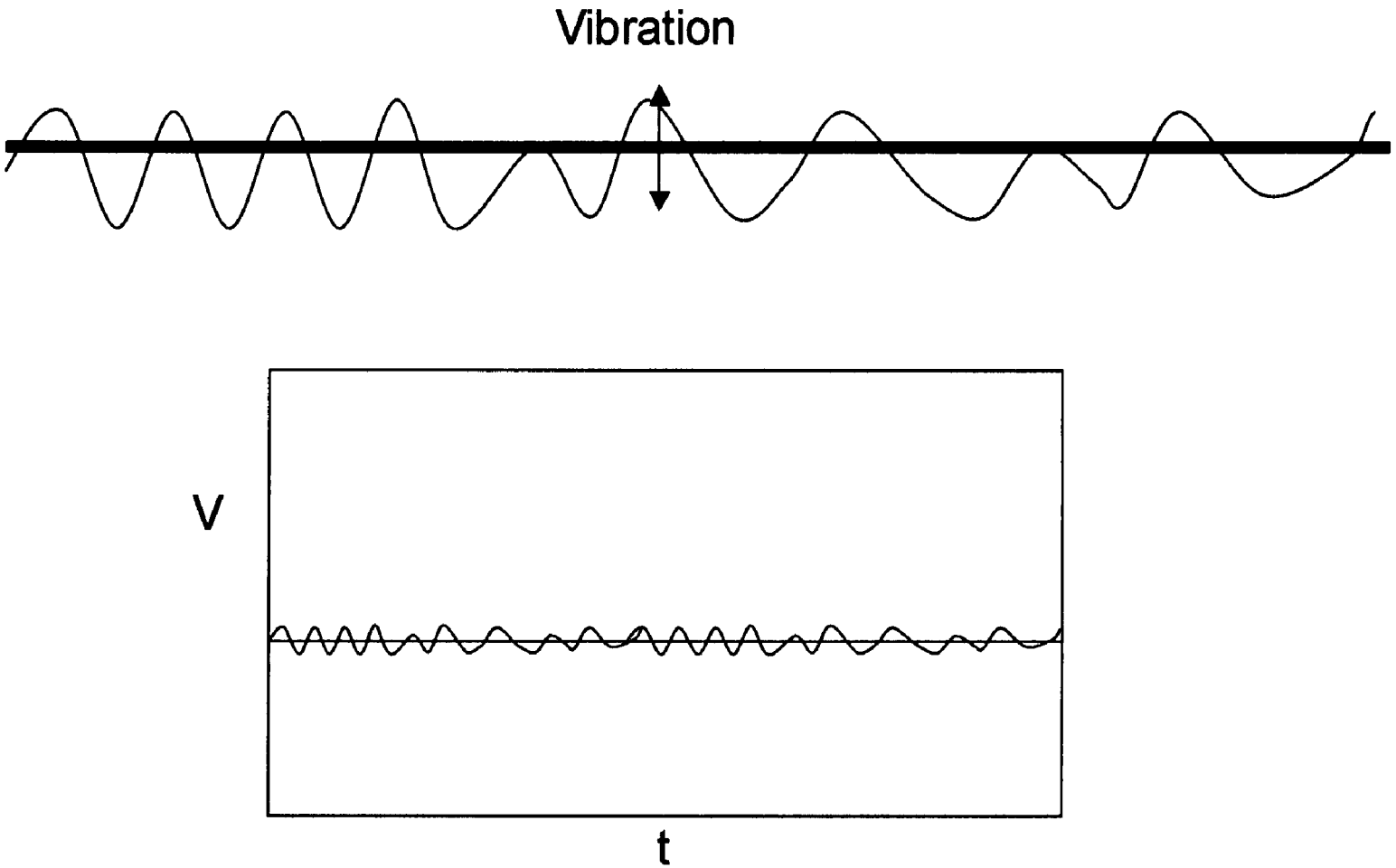
FIG. 1B is a schematic diagram showing that an applied vibration will cause the output voltage to fluctuate measurably.

In the examples that follow, a length of rugged non-metallic conduit about 2 m long was filled with typical electrical signal cables along with one "sensor" cable as illustrated generally in FIG. 1A. The sensor used in this example was constructed using a twisted shielded pair with a negative bias voltage applied to the shield of the cable. One member of the twisted pair in the sensor cable was connected to an amplifier whose output $V_o$ was connected to a computer data acquisition system, in order to capture the dynamic behavior of the output signal $V_o$ in response to physical vibration as shown schematically in FIG. 1B. The computer DAQ system hardware consisted of a Dell Latitude D800 computer and a National Instruments DAQCard-6036E Multifunction I/O card. Data acquisition and analysis software was developed using National Instruments LabVIEW, which is a platform that allows the software developer to create "virtual instruments," or VIs, that can be tailored to specific data acquisition and analysis requirements.

Figure 2:
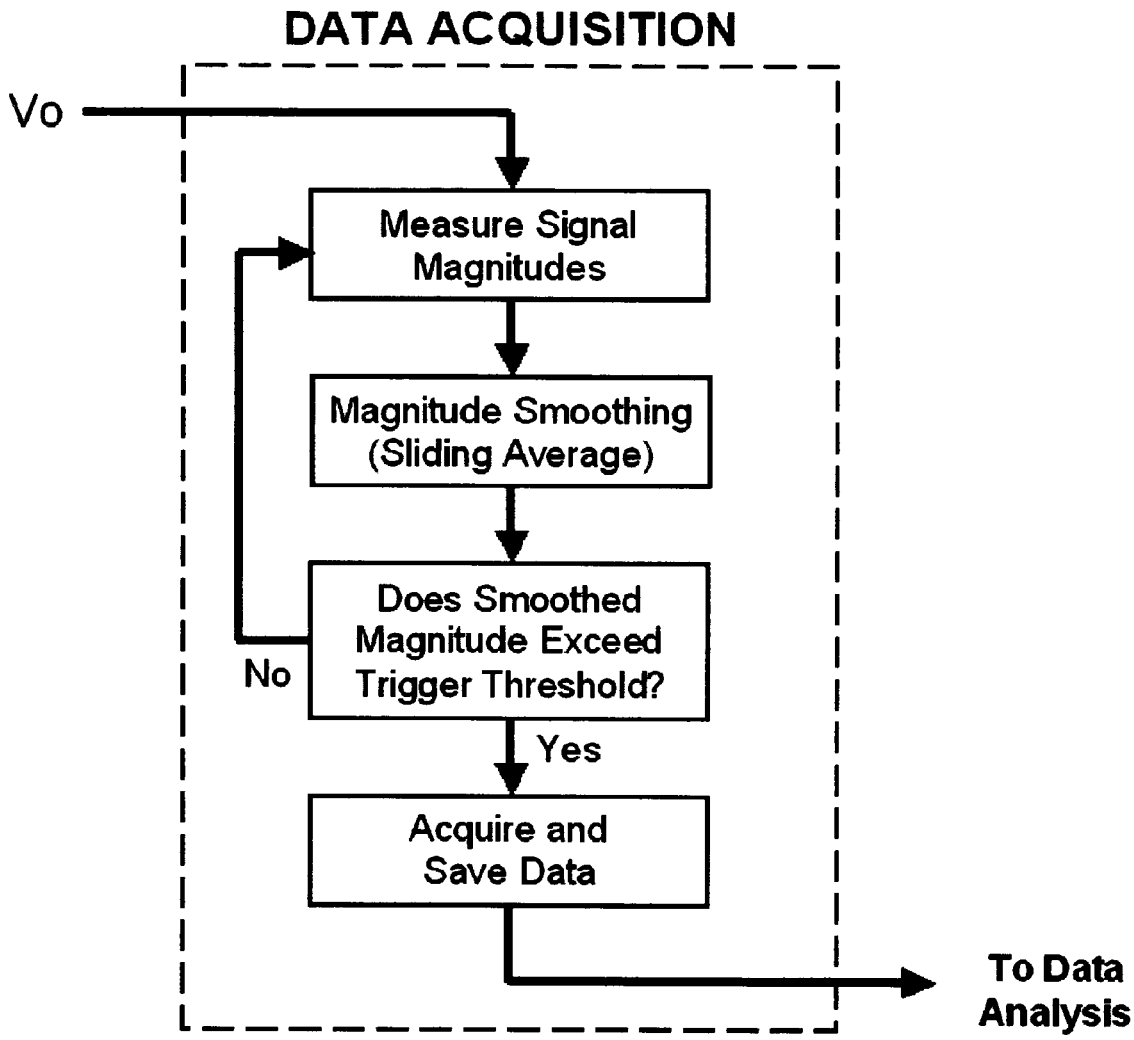
FIG. 2 is a schematic diagram of one embodiment of the data acquisition method of the present invention.

FIG. 2 illustrates one suitable data acquisition process developed to permit the triggered acquisition of a block of data for off-line analysis. Software controls that permit the adjustment of all major data acquisition and display parameters such as the trigger level, sample rate and block size, and graph scaling may be user-adjustable or they may be substantially "preset".

Preliminary evaluations of the distributed capacitance method led to the conclusion that tampering events would likely produce signals that are predominately low frequency in content; thus, Applicants focused their efforts on the development of hardware and software that exploits this finding. With this in mind, the data acquisition software continuously averages the incoming "raw" signal prior to displaying and evaluating the signal. An additional virtual "button" may be provided to compensate for any DC offset that may be present in the signal.

Once the signal conditioning and data acquisition parameters have been adjusted, the software provides another button to "arm" the system. Once armed, the system will acquire a data block whenever the absolute value of the conditioned signal magnitude exceeds the trigger threshold.

Example 1

The sensor cable functions as a distributed capacitance element containing at least two conductive elements. The net capacitance of the cable is determined by the conductor spacing along its length. A bias voltage is applied to at least one of the conductive elements. Any small change in the conductor spacing due to a force applied at any location along the cable length induces a change in the net capacitance. When the capacitance is connected to a circuit (such as the input of the amplifier) a current will flow in response to the change in capacitance. This is represented by the expression $$I=VdC/dt$$

where I represents the induced current, V represents the bias voltage applied to the sensor, and dC/dt represents the change in capacitance over time.

The capacitance will increase as the spacing between the conductors decreases, as would occur under an applied force.

Thus the change in capacitance is proportional to the applied force. When connected to a simple current to voltage converting amplifier, the output voltage produced by the applied current is proportional to the change in applied force over time.

The induced current is a dynamic entity such that a step change in capacitance will result in an induced voltage followed by an exponential decay in the induced voltage. The frequency components in the resulting signal thus vary according to the nature of the force applied to the cable. Slow changes in capacitance, as might be induced by squeezing the sensor cable in a vise produce very low frequency signal components. Rapid changes such as might be induced by striking the sensor cable sharply with a hammer produce higher frequency components. If attached to a source of uniform vibration (such as an out-of-balance motor) the induced current would contain a dominant frequency component representative of the frequency of the vibration. By analyzing the nature of the frequency components in the induced signals, different types of sensor cable disturbances can be recognized according to the characteristic signature of their frequency components. Thus, a tool that is inadvertently dropped onto the sensor cable, or a signal induced by vibrating equipment would have a different characteristic signature than that which would be produced by, for example, grasping and probing the sensor cable. By building up a database of benign event signatures as well as suspicious event signatures, the signal produced by any given event can be compared with the characteristics of that database to ascertain with high probability whether the event is benign or suspicious.

It will be appreciated that other conventional means are known for generating a measurable (amplified) electrical signal based on small changes in capacitance. Some of these include the following: The capacitance may be measured directly by using a commercial impedance meter. A voltage signal of two or more known frequencies may be applied to the capacitance to deduce the capacitance value by measuring the induced current. A current signal of two or more known frequencies may be applied to the capacitance to deduce the capacitance value by measuring the induced voltage. More sophisticated instruments, such as lock-in amplifiers may be used to measure the phase angle of an induced current or voltage in response to an applied voltage or current signal containing two or more known frequencies.

It will be further appreciated that other physical transduction methods are known that can be exploited to create a sensor cable having "microphonic" properties. These include piezoresistive materials (e.g., an insulating polymer filled with conductive particles to just below the percolation threshold), piezoelectric materials, and others.

Determining the cause of a sensor cable signal change can be challenging, especially if there are activities being performed nearby that might result in benign sensor cable movement and/or vibrations. To be useful, a monitoring system should be able to reliably differentiate between tampering and "background" events. When background noise is relatively low or predictable, such as in a facility that is unoccupied and where no machinery is running, the task of differentiating tampering from benign sources becomes much easier.

Simple threshold detectors can detect tampering when little or no background noise is present. For installations where background noise is relatively high, such as in an occupied facility with operating machinery, forklift vehicles, etc., a more comprehensive detection scheme is required.

Example 2

To accommodate the aforementioned "noisy" installations, the present invention not only detects signal magnitudes, and counts signal excursions, but also analyzes signal content in the frequency domain. In that respect, this invention is considerably different from other sensor cable based intruder detection systems, because it considers the frequency patterns and relationships, otherwise known as the signal's "signature."

Signature Analysis methods are performed after first identifying the discrete frequency components in the signal. A Fast Fourier Transform (FFT) is performed to reveal the signal's frequency elements, which are then analyzed in unique ways.

Those skilled in the art will appreciate that various other mathematical techniques exist for converting data from the time-domain to the frequency-domain. These include but are not limited to the Wavelet Transform and the Hilbert Transform.

Example 3

Figure 4:
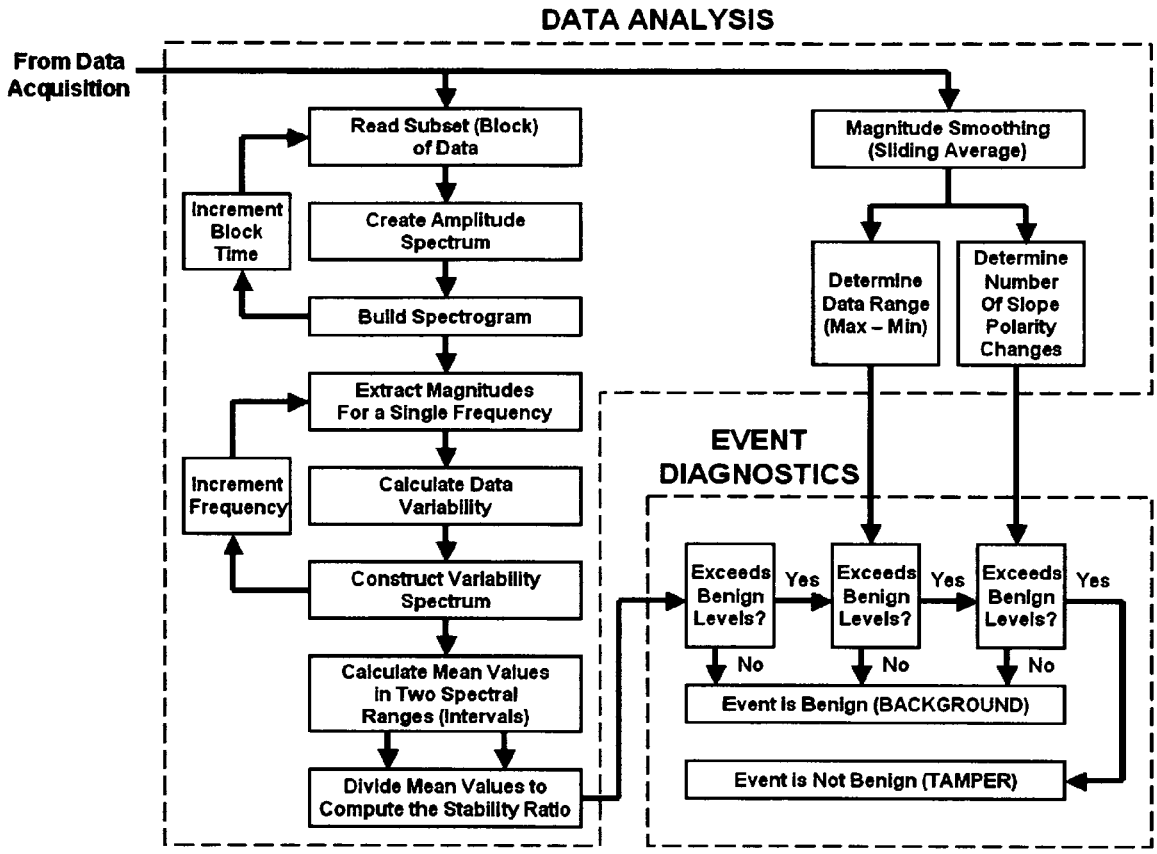
FIG. 4 is a schematic diagram of another embodiment of the data analysis method of the present invention.

The method used for detecting and analyzing the electrical signal from the sensor cable, shown generally at FIG. 4 provides high sensitivity for detecting positional changes or vibration of the conduit or wiring within the conduit. For cases when the electrical signal is substantially contaminated by environmental noise, the extraneous noise can be partially attenuated by means of electrical circuitry, or by digital signal processing means, prior to monitoring.

The electrical signal is monitored continuously, and in real-time. Any change in position of the conduit or wiring will result in an instantaneous change in the magnitude of the electrical signal produced by the sensor cable and associated electronics. The change may be positive or negative, depending on the location and initial direction of the positional change. If the electrical signal exceeds the positive threshold level, or falls below the negative threshold level, the electrical signal is recorded by the data acquisition system for a period of time that is preset by the user. Typically, this period of time is ten seconds.

The ten second "block" of data is then immediately analyzed by several methods in order to better characterize the electrical signal, and thus determine if the changes in the electrical signal magnitude resulted from a benign cause or from tampering. Applicants have found that three methods are particularly useful in distinguishing tampering from benign causes. These methods are (1) Overall Signal Range, (2) Number of Polarity Changes, and (3) Frequency Stability Ratio. Each of these methods is described below.

Overall Signal Range is determined by measuring the difference between the maximum signal magnitude and the minimum signal magnitude. When this signal range is greater than a preset magnitude (e.g., 10 mV), the signal is determined to be large enough to be characterized.

The Number of Polarity Changes is the number of times the "slope" of the data changes during the recorded data block. Changes in slope occur at "peaks" and "valleys" in the data. Each of these peaks and valleys represents a possible positional change of the conduit or wiring within the conduit. If the number of polarity changes are greater than a preset magnitude (e.g., 2), then a tampering event may have occurred.

The Frequency Stability Ratio is a statistical measure of how stable or unstable the frequency content is within a frequency band (or spectral interval) of interest (the alarm band) compared to a much wider frequency band (the reference band). Tests have shown that manual manipulations of an instrumented conduit, for instance, will produce signal changes at very low frequencies, typically below five cycles-per-second (5 Hz). This frequency range is referred to as the "alarm band." Other signal changes occurring between 5 Hz and 30 Hz fall within what is referred to as the "reference band." Thus, for that particular application the preferable frequency ranges are 0 to 5 Hz and 5 to 30 Hz respectively. It will be appreciated that the inventive technique allows wide latitude for choosing the ranges for a particular application and through experimentation the user may optimize the ranges based on experience with the dynamic behavior of the system being monitored. The two bands may overlap (e.g., 0-6 and 4-30 Hz, respectively) or there may be a gap between them (e.g., 1-4 and 6-50 Hz, respectively). The bands do not necessarily extend down to 0 Hz and are not necessarily limited to frequencies below about 30 Hz, but may include whatever frequencies are appropriate to the specific monitoring task.

The average frequency stability is determined within the alarm band and the reference band by the following process. A small data sub-set (typically one second in duration) is extracted from the beginning of the data block. The frequency components of this subset are determined, using an FFT or other method. This process creates a graph called a "frequency spectrum," which displays the signal magnitudes at discrete frequency intervals, called "bins."

In a similar manner, a second data subset is then extracted from the data block. The second data subset has the same time duration as the first data subset, but begins and ends at a slightly later time than the first subset. In this manner, the second subset can be said to "overlap" the first subset. The amount of overlap can be specified by the user, and is typically ninety percent (90%). The frequency components of the second subset are determined as in the first subset, using an FFT or other method. This process is repeated for the third subset, fourth subset, and so on, until the end of the data block is reached.

What results from this processing step is a number of individual frequency spectra (magnitude vs. frequency graphs) that are combined into one graph, called a spectrogram. The spectrogram displays three parameters: magnitude, frequency, and data subset number, all in one graph. One of these parameters can then be held constant, and the variations in the other two parameters can be studied.

For each frequency bin, the magnitude stability for that bin can be measured by a number of statistical methods. The invention presently determines the bin stability by measuring the variance of the magnitudes for the bin and multiplying the variance by the corresponding mean value. The average bin stability within the alarm band and the average stability within the reference band may be thus determined.

Tests have shown that manual conduit manipulations produce irregular (unstable) signal variations. Conduit vibrations due to structural resonances or from nearby vibrating equipment such as motor-driven pumps and fans produce very stable vibrations and thus very stable signal variations. The average alarm band stability measurement is divided by the average reference band stability measurement. A small quotient indicates that the frequency content in the alarm band is relatively stable, while a large quotient indicates that the frequency content in the alarm band is relatively unstable. When the quotient is greater than a preset magnitude, typically 20, it is determined that a tampering event may have occurred.

Those skilled in the art will appreciate that Applicants' method differs from many traditional security systems in that it does not use the threshold value per se to determine an alarm condition, but rather uses the threshold only as the first step of triggering the data acquisition system to collect data for further study. Although three particular signal metrics have been detailed above, other frequency domain characteristics might be useful for implementing an embodiment of the invention for a particular application without undue experimentation.

Furthermore, the polarity change characteristic does not seem to be a frequency domain characteristic per se and yet it is a substantial departure from conventional means for analyzing signals from this type of sensor. As used herein, the term "signal analysis" includes any and all of the aforementioned measurements, including polarity change characteristics.

Figure 3:
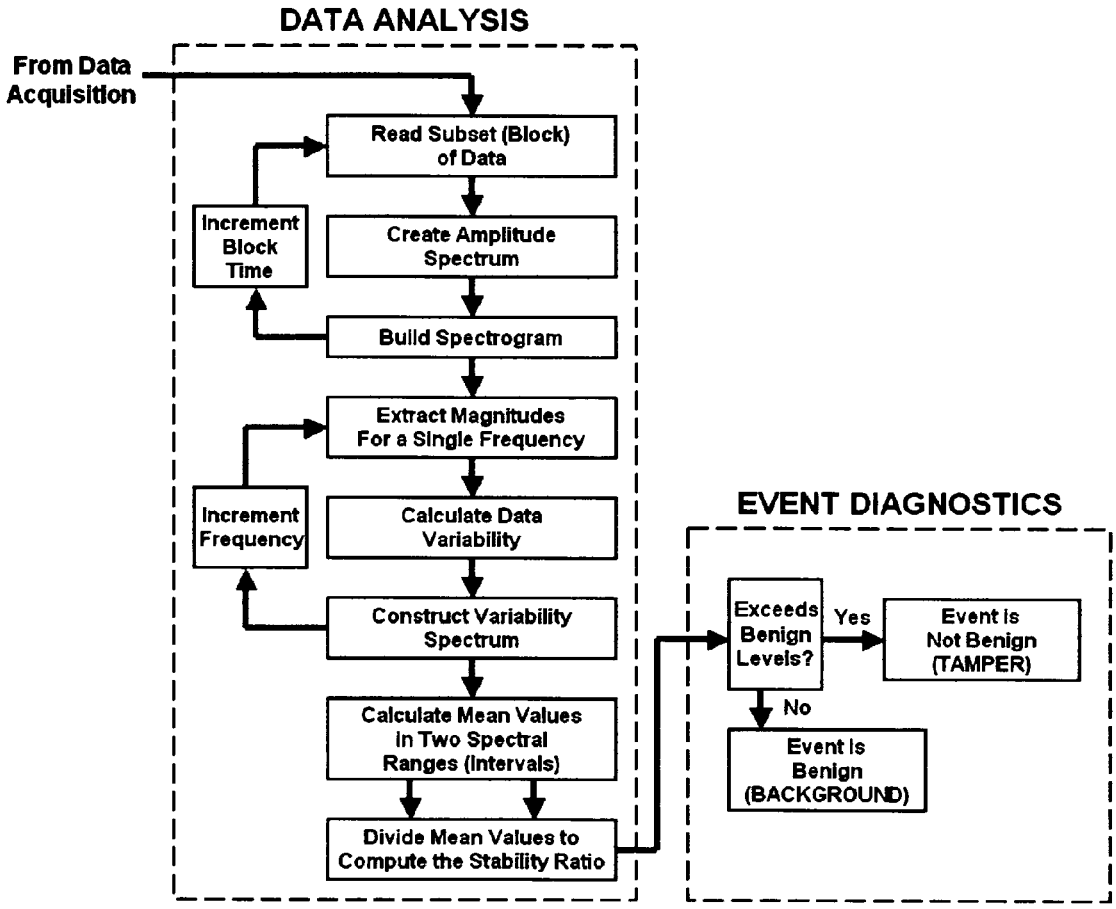
FIG. 3 is a schematic diagram of one embodiment of the data analysis method of the present invention.

In some situations, adequate information may be contained in the parameter referred to as Stability Ratio. In such cases the Data Analysis system may be simplified as shown schematically in FIG. 3.

Example 4

A multi-tiered decision making process as shown schematically in FIG. 4 may be used to determine the type of event that has been recorded and analyzed using the aforementioned three methods. The event is determined to have resulted from conduit tampering only when criteria from all three methods are met. If one or more of the criteria are not met, the recorded event is presumed to have resulted from an environmental (background) cause.

It will be appreciated that all security systems face trade-offs regarding sensitivity, convenience, cost and complexity, and so on. The general goal is to minimize false positives with (ideally) no false negatives. Thus, the present invention can be optimized for the constraints of a particular installation without undue experimentation by considering the overall operating environment of vibration, shock, and electrical noise and selecting the parameters that will be used to test for alarm conditions. An optimal solution will use the fewest parameters needed to achieve the general goal stated above.

As noted above, signature analysis methods may be used to decide whether a particular signal represents a benign event or a tampering event. Applicants prefer to use a decision methodology wherein signatures of known benign vibrations are collected and the system flags as a tampering event any signature that does not match any known benign event. Applicants' preference is based on the fact that it is very difficult to anticipate every possible type of tampering event, whereas it is generally easier to anticipate routine or background vibrations in the environment in question. Nevertheless, it will be appreciated that in some situations, it may be appropriate to collect signatures of certain (likely) kinds of tampering events and base a decision model on matching to these, instead of (or in addition to) a model based on signatures that do not match benign events.

Example 5

To minimize false alarms, the invention may use a combination of different analysis methods (preferably three) to detect conduit tampering. It will be appreciated that other data analysis methods could also be useful in differentiating tampering events from background causes. These methods can be developed empirically, through routine experimentation using data from known tampering and benign events. Alternatively the data analysis methods can be identified automatically, through the use of artificial intelligence software.

In the exemplary embodiment described above, Applicants prefer to analyze signals over the bandwidth between about 0 Hz to 30 Hz. It will be appreciated that a wider or narrower bandwidth may be selected by a user for a particular installation and that the optimal bandwidth may be established through routine experimentation, taking into account such factors as the amount and type of noise present in the area to be monitored, as noted above.

Example 6

In the foregoing examples, the invention was directed to monitoring tampering in an electrical cable or conduit. It will be appreciated that a substantially flexible, microphonic cable may be deployed to monitor suspicious movements in other types of structures. These include fences and other perimeter control devices, bridge support cables, flexible handrails (e.g., on catwalks, pedestrian bridges, and the like), flexible pipes, hoses, or ducts, etc. The sensor cable may also be affixed to a flexible surface such as a tent or tarp, or even woven into a fabric, rug, etc., where it may be small enough to be substantially unobtrusive.

Example 7

All of the functions described in the foregoing examples may be performed by any desired combination of hardware and software as are well known in the art. For example, instead of general-purpose computer, data acquisition, and data analysis systems (virtual instrument) one could construct a device specifically for this purpose, which would therefore be substantially smaller and simpler because it eliminates all of the unneeded components of the aforedescribed general-purpose systems. Such a small, portable device and a length of sensing cable could be conveniently deployed for short-term perimeter control applications, such as securing a crime scene. The device may further contain wireless communication means whereby it may send data and/or receive instructions from a central monitoring station. Many suitable wireless communication devices and protocols are well known in the art.

Example 8

In some of the foregoing examples, it was contemplated that data are collected over a preset time interval that begins upon some triggering event, which may be detected by the sensor cable itself. It will be appreciated that the device may be configured to collect data at routine intervals, or collect data continuously while analyzing the contents of a moving time window. Alternatively, it may be configured to be triggered by an external device or operator. For instance, if the sensor cable is deployed in a fence or other perimeter control device, it may be configured to be triggered by a nearby motion detector; in this mode, the motion detector alerts the perimeter sensor that something is moving in the area and the perimeter sensor can then move to a higher state of monitoring. Alternatively, guard personnel watching video monitors may see suspicious movement and manually trigger the device to begin acquiring data more intensively. A person moving outside the perimeter who does not attempt to cross the perimeter may be considered benign.

It can be seen, therefore, that the skilled artisan may easily adapt the invention to various applications and optimize various operating parameters and characteristics to achieve such goals as minimizing false alarms, extending battery life, and so on.

In some of the foregoing examples, the data acquisition and analysis systems used digital signal processing techniques. However, because the method relies on the analysis of two frequency ranges, those skilled in the art will appreciate that analog computing methods in combination with simple digital circuits may also be used to achieve the same effective results. For example, a quantity representing the Overall Signal Range could be developed by using a sample and hold circuit to store the peak signal intensity during a maximum excursion and comparing it with a long term average of the signal intensity during quiescent conditions. The instantaneous intensity in a given frequency band can be determined using bandpass filters, analog multiplier circuits, and analog integration circuits to develop a voltage representing the magnitude of the signal within the frequency band. The Number of Slope Changes could be determined by using an analog differential amplifier to determine the instantaneous slope of the signal and a comparator circuit to determine when the slope changed from positive to negative. The number of such changes in a given time interval could be counted using a simple digital counter.

Circuitry elements including amplifiers, frequency-selective filters, analog summing circuits, analog multiplication circuits, threshold detectors, counters, low-level logic circuits, and shift registers are well known to those skilled in the art. The general characteristics of active bandpass filters and analog computing circuits are well known and described in texts such as E. J. Kennedy's, *Operational Amplifier Circuits Theory and Applications* (Holt, Reinhart and Winston, Inc. 1988). Multiplication, division, and squaring functions are easily performed with commercially available integrated circuits such as the Analog Devices AD534[Analog Devices, One Technology Way, P.O. Box 9106, Norwood, Mass. 02062-9106].

We claim:

1. A method for detecting a tampering condition with a structure comprising:

disposing a sensor cable in mechanical contact with the structure, the sensor cable configured to produce an electrical signal in response to mechanical forces;

measuring the electrical signal;

analyzing the electrical signal while unrectified to detect a tampering condition, the analyzing comprising:

collecting data from the electrical signal over a sampling time interval;

counting each local slope change from the collected data for a polarity analysis;

computing a frequency stability ratio for the collected data for a frequency analysis;

comparing an amplitude of the collected data with a preset magnitude for an amplitude analysis; and identifying the tampering condition based on the amplitude analysis, the frequency analysis, and the polarity analysis, wherein the amplitude analysis, the frequency analysis, and the polarity analysis are performed substantially simultaneously on the electrical signal.

2. The method of claim 1 wherein the identifying based on the polarity analysis comprises when the count of local slope changes exceeds a preset number, which comprises a maximum number of local slope changes over the sampling time interval.

3. The method of claim 2 wherein the count of local slope changes includes each local peak and each local valley.

4. The method of claim 1 wherein the identifying based on the amplitude analysis comprises when the amplitude of the collected data exceeds a preset magnitude.

5. The method of claim 1 wherein the identifying based on the frequency analysis comprising determining when an average of the frequency stability ratio for the collected data exceeds a predetermined magnitude.

* * * * *